US011788272B2

(12) United States Patent
Van Ee

(10) Patent No.: US 11,788,272 B2
(45) Date of Patent: Oct. 17, 2023

(54) STAXMAX SMOOTH CUBE

(71) Applicant: Jonathan Hendrik Van Ee, Dublin, CA (US)

(72) Inventor: Jonathan Hendrik Van Ee, Dublin, CA (US)

( * ) Notice: Subject to any disclaimer, the term of this patent is extended or adjusted under 35 U.S.C. 154(b) by 56 days.

(21) Appl. No.: 17/305,451

(22) Filed: Jul. 7, 2021

(65) Prior Publication Data

US 2022/0042300 A1 Feb. 10, 2022

Related U.S. Application Data

(60) Provisional application No. 62/706,228, filed on Aug. 6, 2020.

(51) Int. Cl.
*E04B 1/343* (2006.01)
*A63H 33/10* (2006.01)

(52) U.S. Cl.
CPC ..... *E04B 1/34331* (2013.01); *A63H 33/10* (2013.01)

(58) Field of Classification Search
CPC ..... A63H 33/04; A63H 33/10; A63H 33/101; A63H 33/107; A63F 9/0865; E04B 2/42; E04B 2002/0256; E04B 1/34315; E04B 1/34331; E01C 5/00
See application file for complete search history.

(56) References Cited

U.S. PATENT DOCUMENTS 3,747,261 A * 7/1973 Salem ..... B23Q 1/545 446/124
4,792,319 A * 12/1988 Svagerko ..... A63H 33/08 446/104
6,050,873 A * 4/2000 Reisman ..... A63H 33/062 446/128
2005/0075035 A1* 4/2005 Hatting ..... A63H 33/101 446/85
2012/0032393 A1* 2/2012 Leicht ..... A63H 33/107 273/156
2013/0165012 A1* 6/2013 Klauber ..... A63H 33/04 446/102
2018/0339237 A1* 11/2018 Lim ..... A63H 33/106
2020/0238190 A1* 7/2020 Tusacciu ..... A63H 33/08
2021/0282373 A1* 9/2021 Boileau ..... A63H 33/062

* cited by examiner

*Primary Examiner* — William V Gilbert

(57) ABSTRACT

The StaxMax Smooth Cube is a puzzle that can assemble secure structures with flat surfaces without tools. It is a puzzle, the purpose of which is to disassemble the cube and assemble it together with other cubes into smooth structures. The Invention does this with a skeletal piece into which other panel pieces are assembled to form a smooth flat cube. The assembled smooth flat cube is locked shut with a snapping mechanism inside the cube that is activated with a magnet through the firm outer flat surface of the cube. The smooth cubes are unlocked and disassembled with the magnets of other smooth cubes. The panel pieces that snap into the backbone piece to form a smooth flat cube also serve to secure the flat cube to other flat cubes when they are disassembled and assembled.

1 Claim, 7 Drawing Sheets

STAXMAX SMOOTH CUBE

BACKGROUND OF THE INVENTION

Field of the Invention

The StaxMax Smooth Cube (the "Invention") is an equilateral cube with fully smooth sides that can be disassembled and assembled with other smooth cubes to form larger constructions with fully smooth sides, without any tools and with interior passage ways that allow for a wide array of building features including reinforcement, locks among and within cubes, pipes, air ducts, power lines, etc.

Description of Related Art

Hollow building blocks with smooth sides that require cement or other tools to be assembled into a building or structure.

Puzzle pieces that can be opened or disassembled by moving around objects inside the puzzle without tools.

BRIEF SUMMARY OF THE INVENTION

The Invention empowers builders to build buildings, structures and toys that can be assembled into useful things with smooth sides like tables, chairs, boxes, walls, sidewalks and a wide array of additional things.

The Invention is itself a puzzle that is solved when it is opened and its internal magnetic snap mechanism, and related snap and beam pieces, are understood and reassembled into a smooth cube.

The Invention enables versatile modular construction because it can be assembled, disassembled, or stored in an unassembled configuration depending on the user's need, or lack of need, for useful things like tables, chairs, boxes, walls, etc.

The Invention's basic features are generally either the same size as that of other features, or half the size, a fourth the size or double the size of other pieces or features, which makes the Invention easier to understand so the user can focus on building things instead of figuring out how to assemble cumbersome traditional building blocks of the same size or how to cut and assemble building materials like wood.

BRIEF DESCRIPTION OF THE SEVERAL VIEWS OF THE DRAWINGS

FIG. 1A's dimensions are simple ratios of the total size of the cube such that the cylinder holes on the edges that are visible close-up in FIG. 1C are ⅛ the width of the total cube and ½ the size of the corner cube area they open to.

FIG. 1A, is locked by FIG. 10.

FIG. 13A is inserted into each of the corners of FIG. 1A and when the column that is FIG. 2A is also inserted vertically into FIG. 1A.

FIG. 15 is secured in place by the "s" snaps that can be seen on FIG. 15.

DETAILED DESCRIPTION OF THE INVENTION

Figure 1A:
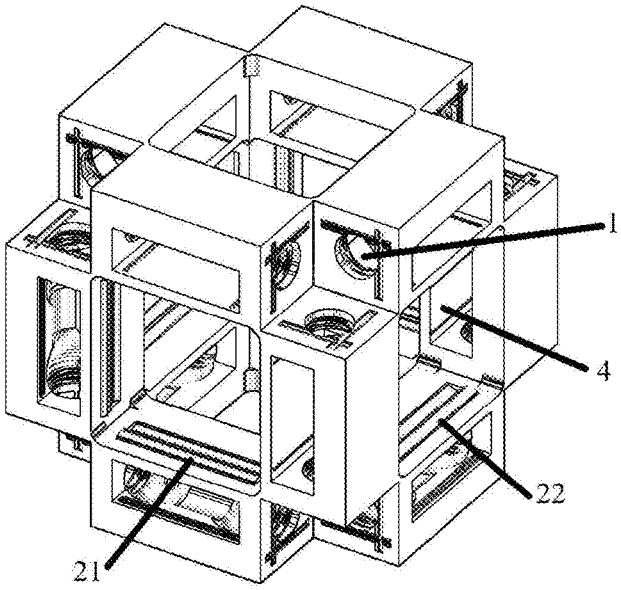
FIG. 1A is a view of the basic backbone of the cube onto which other pieces become affixed to form a smooth surface.
Figure 1B:
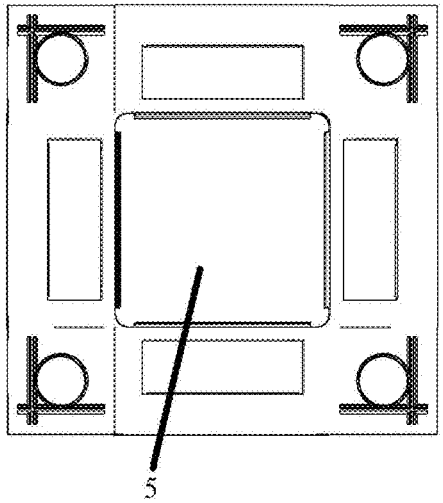
FIG. 1B is a side profile view of FIG. 1A.
Figure 1C:
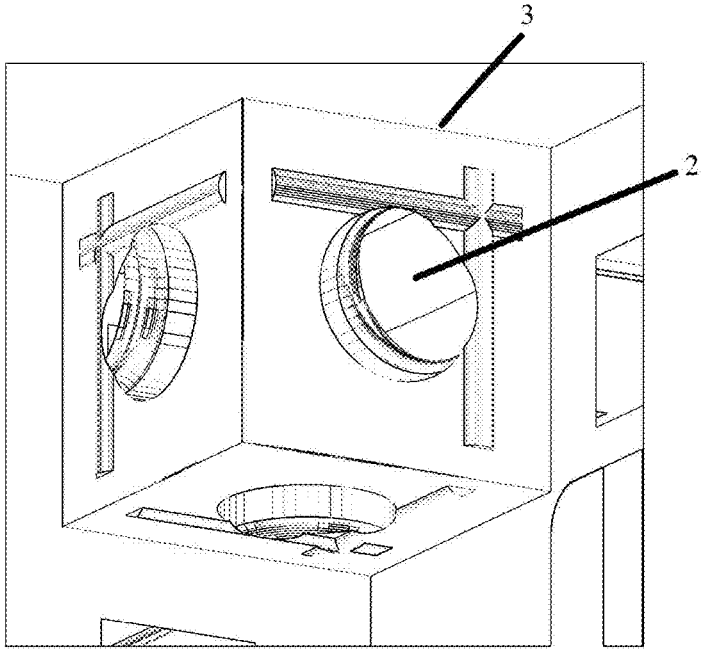
FIG. 1C is a close-up view of FIG. 1A.
Figure 2A:
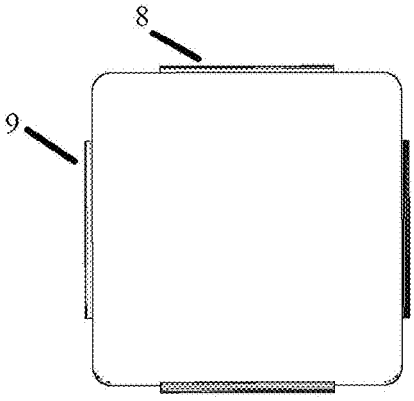
FIG. 2A is a top view of the column that is FIG. 2C.
Figure 2B:
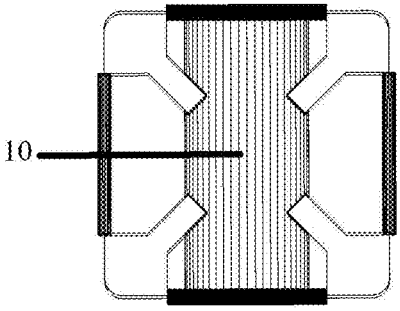
FIG. 2B is a wireframe view of FIG. 2A.
Figure 2C:
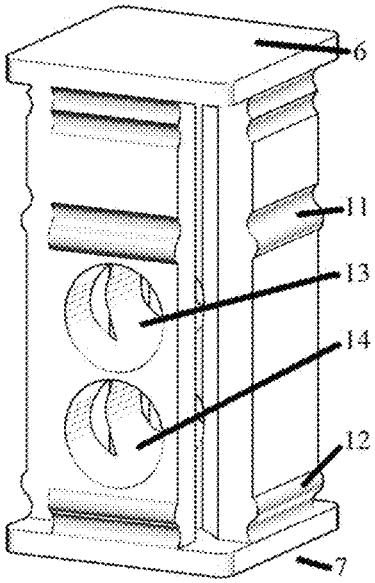
FIG. 2C is a column with flat ends that fits into the openings at the middle of FIG. 1A.
Figure 2D:
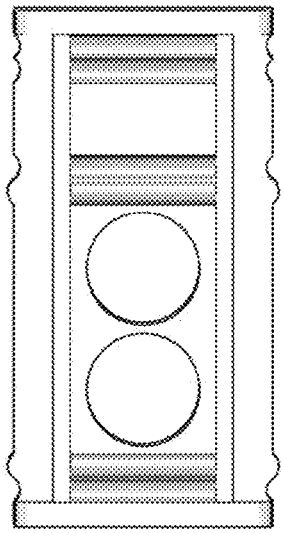
FIG. 2D is a side profile view of FIG. 2C.

FIG. 1's dimensions are simple ratios of the total size of the cube such that the cylinder holes on the edges (1) that are visible close up in FIG. 1C (2) are ⅛ the width of the total cube and ½ the size of the corner cube area they open to (3). The square opening in the middle of each side of FIG. 1 (4, 5) is ½ the size of the entire cube as can be seen in FIG. 1B.

FIG. 2 is a column with flat ends (6, 7) that fits into the openings at the middle of FIG. 1 (4,5). FIG. 2A is a solid profile view from the top where the "s" snaps protrude slightly on the sides (8, 9). FIG. 2B is a wireframe profile view from the top in which the column, that has the shape of a plus sign ("+") can be seen (10). FIG. 2C is a column with flat ends (6, 7) that fits into the openings at the middle of FIG. 1A (4). FIG. 2C is a vie of the column at an angle and in an upright position where the top flat end can be seen along with the "s" shaped snaps on the sides (11, 12) and the two cylindrical holes in the middle and bottom part (13, 14).

FIG. 3 is the casing for the snap mechanism that goes in the large middle openings of FIG. 1 (4). Its flat outer surface can be seen in FIG. 3B (15). FIG. 3A shows the opening (16) just under the flat outer surface (17) where the magnetic disc in the shape of a coin is inserted. This opening also appears towards the top of FIG. 3D (18). The curving surface in the shape of an "s" towards the bottom of FIGS. 3A (19) and 3D (20) is a snap that fits into corresponding indentations and protrusions on the basic backbone of the Invention in FIG. 1 (21, 22). While the opening of the basic backbone in FIG. 1 is square (4) and the corresponding "s" snap area on FIG. 3 is round (23), they will nonetheless fit together snugly. FIG. 3 can therefore snap into round and square (4) openings. FIG. 3C is a view of the casing from the inside, non-flat side, where FIG. 4 snaps in (24). FIG. 3C shows the flexible middle part of the round center area (25). This center part pushes up when the magnetic disc below is pushed in. When that center part rises it pushes FIG. 4 out.

Figure 3B:
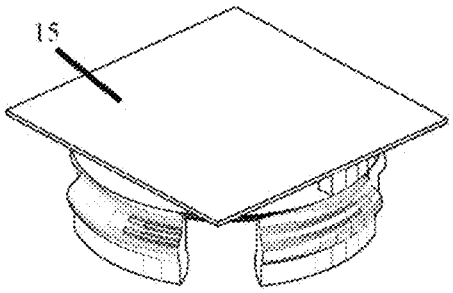
FIG. 3B is a view of the top of FIG. 3A.
Figure 3A:
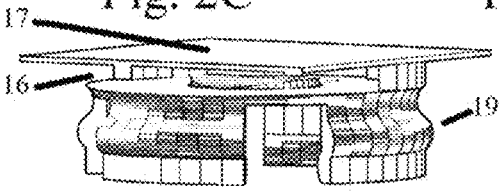
FIG. 3A is the casing for the snap mechanism that goes in the large middle openings of FIG. 1A. Its flat outer surface can be seen in FIG. 3B.
Figure 3C:
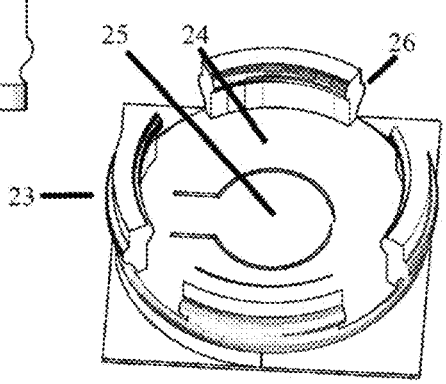
FIG. 3C is a view of the bottom of FIG. 3A.
Figure 4A:
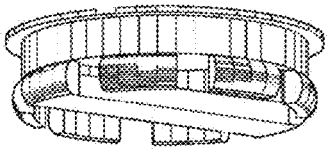
FIG. 4A reinforces the snap grip of FIG. 3A by snapping into its opening that is easily visible in FIG. 3C.
Figure 3D:
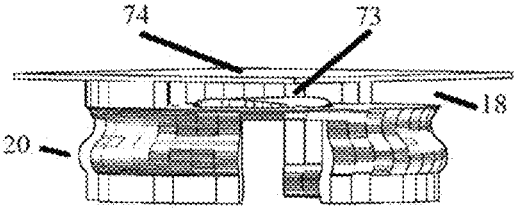
FIG. 3D is a side view of FIG. 3A.
Figure 4B:
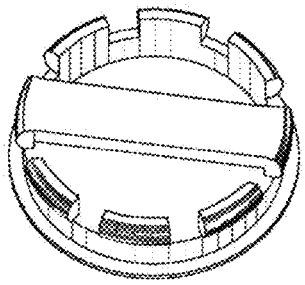
FIG. 4B is another view of FIG. 4A.
Figure 4C:
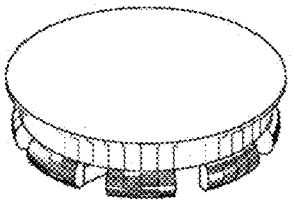
FIG. 4C is another view of FIG. 4A.

FIG. 4 reinforces the snap grip of FIG. 3 (26) by snapping into its opening (24) that is easily visible in FIG. 3C.

Figure 5A:
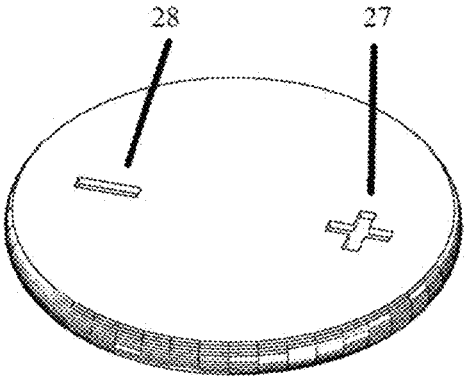
FIG. 5A is a magnetic disc that has both positive and negative charges on each side of the disc which allows it to pull itself together when the opposite charged areas are placed opposite each other. It can also repel from itself when sides with the same charge are placed opposite each other.
Figure 5B:
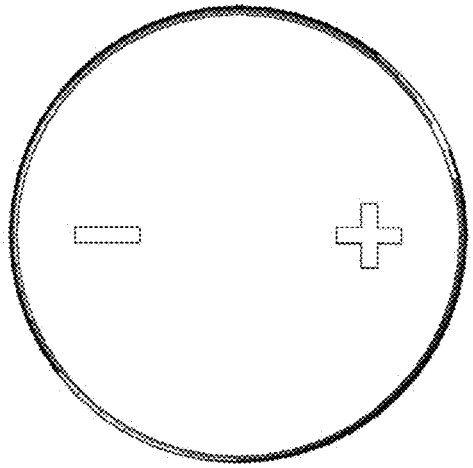
FIG. 5B is a profile view from the top of FIG. 5A.

FIG. 5 is a magnetic disc that has both positive (27) and negative (28) charges on each side of the disc which allows it to pull itself together when the opposite charged areas are placed opposite each other. It can also repel from itself when sides with the same charge are placed opposite each other.

Figure 6:
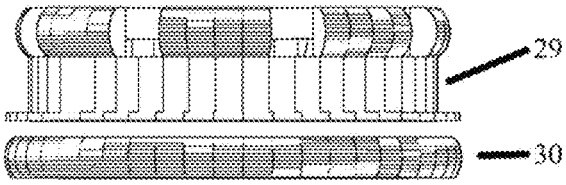
FIG. 6 shows the relative position that FIG. 4A occupies on top of FIG. 5A when the Invention is snapped together in a secure configuration.

FIG. 6 shows the relative position that FIG. 4 (29) occupies on top of FIG. 5 (30) when the Invention is snapped together in a secure configuration.

Figure 7:
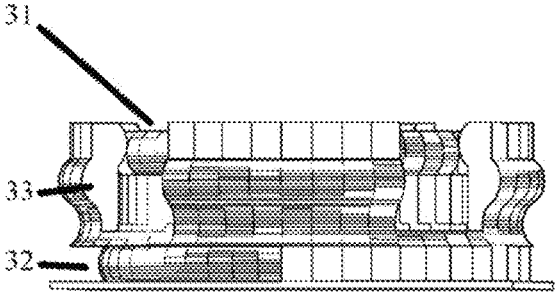
FIG. 7 shows the same position of FIGS. 4A and 5A described in FIG. 6 and it also shows how those FIGS. 4A and 5A fit into FIG. 3A.

FIG. 7 shows the same position of FIGS. 4 (31) and 5 (32) described in FIG. 6 and it also shows how those FIGS. 4 and 5 fit into FIG. 3 (33). This is the arrangement of the pieces when they are snapped together and also snapped into FIG. 1 to form a flat surface on a middle side of FIG. 1 (4).

Figure 8:
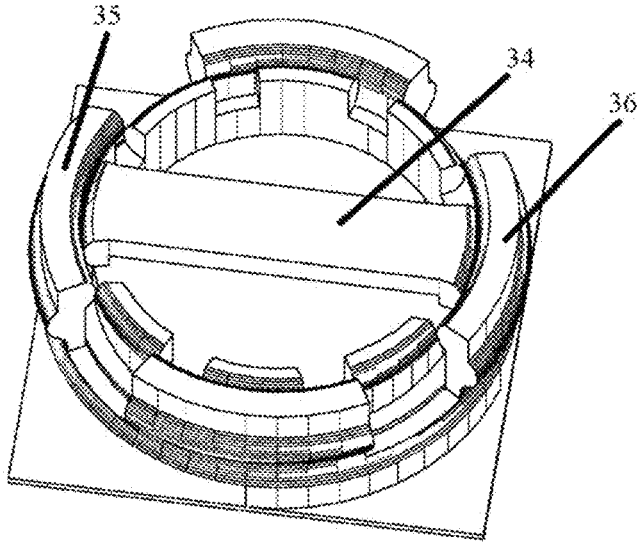
FIG. 8 is a different view of FIG. 7 that shows how the straight bar in the middle of FIG. 4, which is inserted into FIG. 3A, pushes out with extra force because it is lodged against the sides of FIG. 3A that stick up.

FIG. 8 is a different view of FIG. 7 that shows how the straight bar in the middle of FIG. 4 (34), which is inserted into FIG. 3, pushes out with extra force because it is lodged against the sides of FIG. 3 that stick up (35, 36).

Figure 9A:
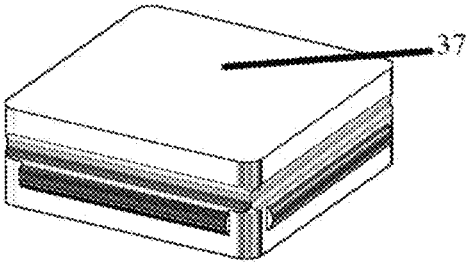
FIG. 9A is a flat surface that snaps into the middle openings of FIG. 1A that are not filled with the magnet/snap configuration shown in FIGS. 7 and 8.
Figure 9C:
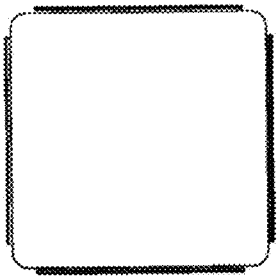
FIG. 9C is a top profile view of FIG. 9A.
Figure 9B:
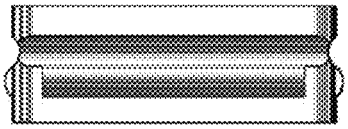
FIG. 9B is a side profile view of FIG. 9A.

FIG. 9 is a flat surface (37) that snaps into the middle openings of FIG. 1 (4) that are not filled with the magnet/snap configuration shown in FIGS. 7 and 8.

Figure 10:
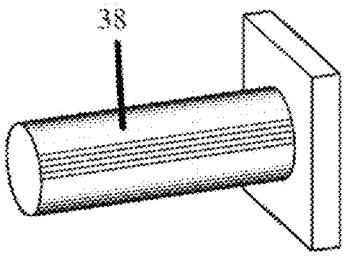
FIG. 10 is a locking device that fits into the middle square area of FIG. 1A to lock in place the beam that is FIG. 2A.

FIG. 10 is a locking device that fits into the middle square area of FIG. 1 (4) to lock in place the beam that is FIG. 2 when its cylindrical protrusion (38) inserts into the cylindrical openings of FIG. 2 (13, 14).

Figure 11:
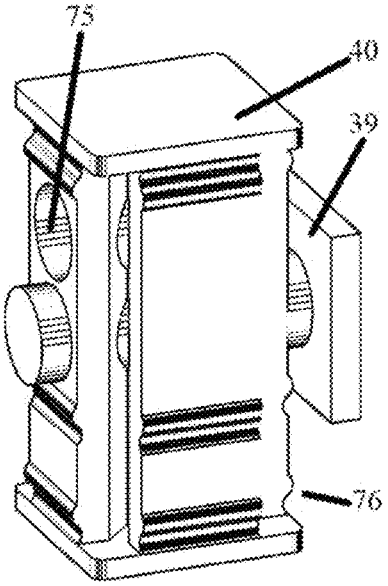
FIG. 11 is a demonstration of how FIG. 10 locks into FIG. 2A.

FIG. 11 is a demonstration of how FIG. 10 (39) locks into FIG. 2 (40).

Figure 12:
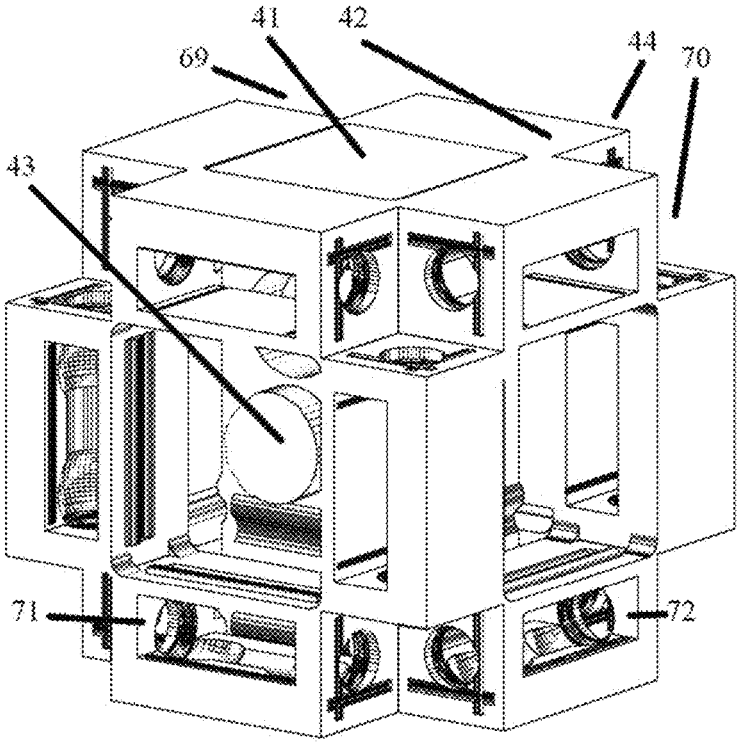
FIG. 12 shows how FIG. 2A, when inserted into

FIG. 12 shows how FIG. 2 (41), when inserted into FIG. 1 (42), is locked by FIG. 10 (43). FIG. 9 can be snapped into the back-right side of FIG. 12 (44) to form a flat surface on that side of the cube. That is a locked arrangement because, when FIG. 9 is snapped in to form a flat surface, it cannot be easily pulled back out. However, the cube can be unlocked by pushing FIG. 10 (43) out of FIG. 1 (42) when it is in the locked position shown in FIG. 12. That will in turn push out FIG. 9 that is behind FIG. 10 (43) when FIG. 10 is pushed out in the direction of the back right of FIG. 12 (44).

Figure 13A:
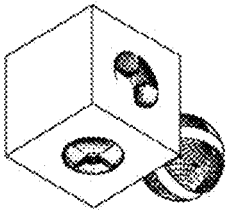
FIG. 13A is the corner cube that can be inserted into the cylinders at the corners on FIG. 1A.
Figure 13B:
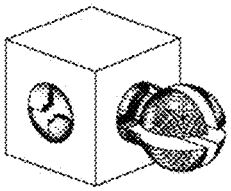
FIG. 13B is another view of FIG. 13A.
Figure 13C:
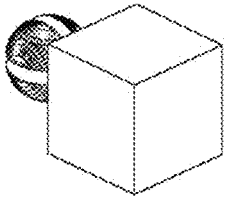
FIG. 13C is a view of the smooth sides of FIG. 13A.

FIG. 13 is the corner cube that can be inserted into the cylinders at the corners on FIG. 1 (1).

Figure 14:
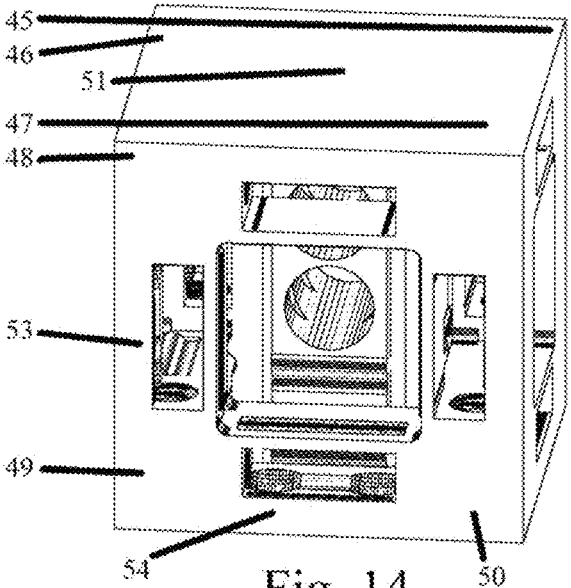
FIG. 14 shows the smooth surfaces created when

FIG. 14 shows the smooth surfaces created when FIG. 13 is inserted into each of the corners of FIG. 1 (45, 46, 47, 48, 49, 50) and when the column that is FIG. 2 is also inserted vertically into FIG. 1 (51).

Figure 15:
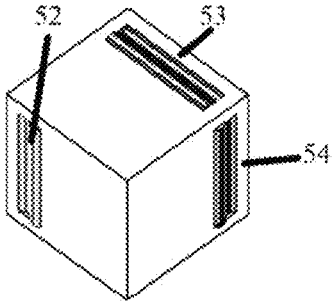
FIG. 15 performs the function of smoothing out the corners just like FIG. 13A except

FIG. 15 performs the function of smoothing out the corners just like FIG. 13 except FIG. 15 is secured in place by the "s" snaps that can be seen on FIG. 15 (52, 53, 54). When FIG. 15 is affixed to each corner of FIG. 1 the cube will have the appearance shown in FIG. 14 with smooth corners (45, 46, 47, 48, 49, 50).

Figure 16A:
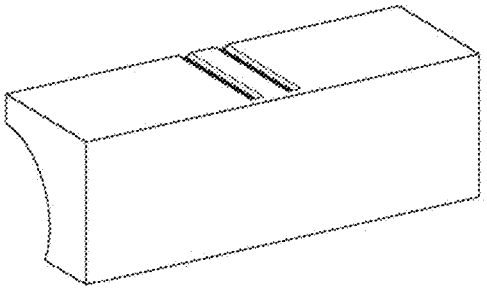
FIG. 16A is a panel that is inserted into the openings of FIG. 18A at 90-degree angles secures two FIG. 18A objects together.
Figure 16B:
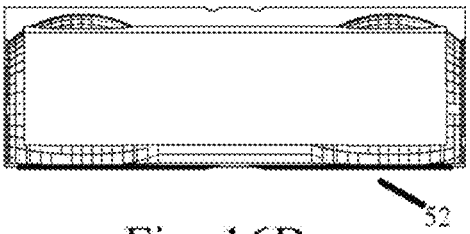
FIG. 16B is a profile view of the back of FIG. 16A.
Figure 16C:
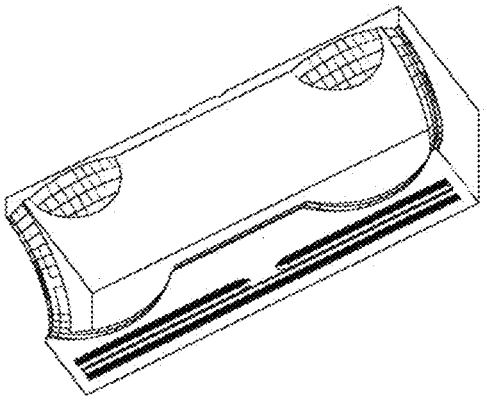
FIG. 16C is another view of FIG. 16A.

FIG. 16 is a panel with "s" snaps (52) that are inserted into the rectangular openings on each side of FIG. 1, which can be seen in FIG. 14 (53, 54).

Figure 17:
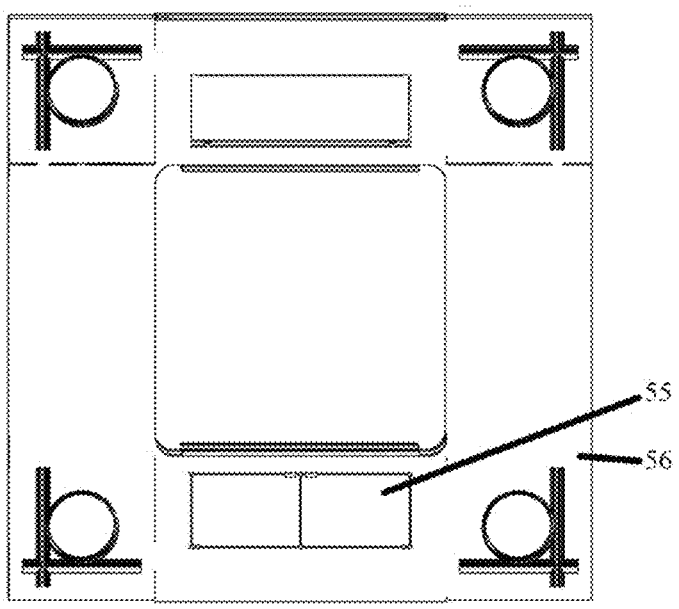
FIG. 17 is a profile view of FIG. 1A with FIG. 16A inserted to form a flat surface.

FIG. 17 shows FIG. 16 (55) inserted into FIG. 1 (56) to form a flat surface.

Figure 18A:
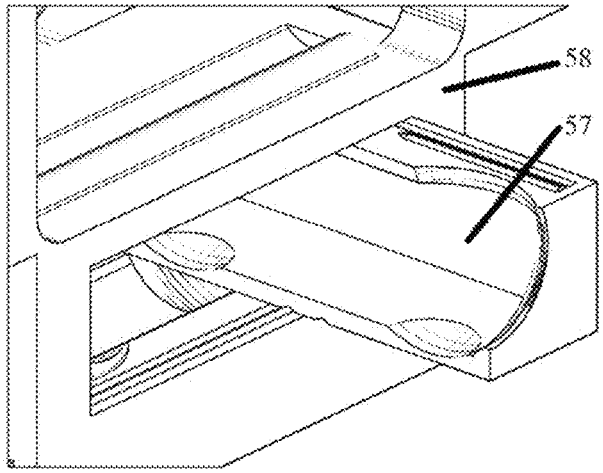
FIG. 18A is a close-up view of FIG. 1A with a demonstration of how a FIG. 16A panel fits into it at a 90-degree angle.
Figure 18B:
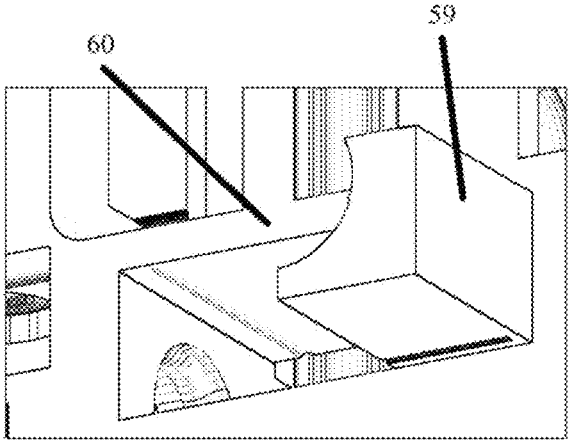
FIG. 18B is another view of FIG. 18A.

FIG. 18 shows FIG. 16 (57) inserted into FIG. 1 (58) at an angle so that it can unite two FIG. 1 objects. FIGS. 18A and 18B are two views of the same object that is FIG. 16 (57, 59) inserted into FIG. 1 (58, 60).

Figure 19A:
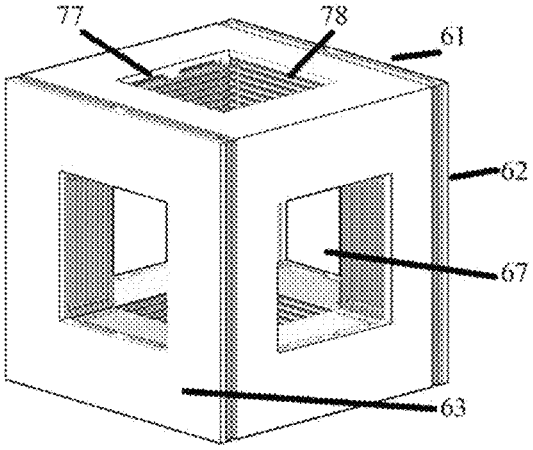
FIG. 19A follows the same basic "s" snap logic as FIG. 1A except that the snap is smaller to the point where it can appear to be ornamental.
Figure 19B:
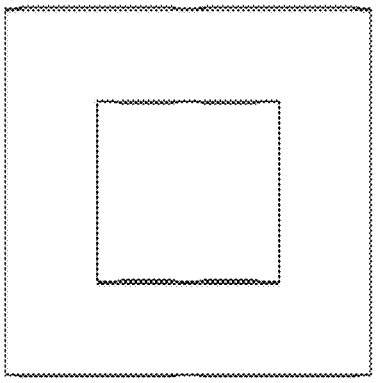
FIG. 19B is a profile view of one side of FIG. 19A.
Figure 19C:
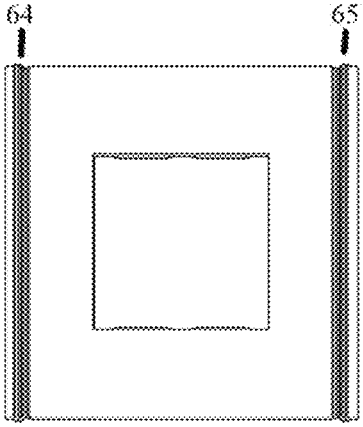
FIG. 19C is another profile view from another side of FIG. 19A.

FIG. 19 follows the same basic "s" snap logic as FIG. 1 except that the snap is smaller to the point where it can appear to be ornamental. The ornamental "s" snap appears on four of the shape depicted in FIG. 19 two of which can be seen in FIG. 19 (61, 62) but it does not appear on two opposing sides, one side of which is shown in FIG. 19B (63). FIG. 19C shows a profile view of sides that have the "s" snap (64, 65). FIG. 19 is also simpler than FIG. 1 in that it does not have spaces for corner pieces to be inserted into the outside corners of the cube (64, 65).

Figure 20A:
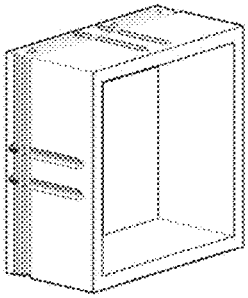
FIG. 20A is a panel that can be inserted into the openings of FIG. 19A both to create a smooth surface and, when inserted at a 90-degree angle to the opening, it secures two FIG. 19A objects together in the same manner that FIG. 16A holds FIG. 1A as is demonstrated in FIGS. 18A and 18B.
Figure 20B:
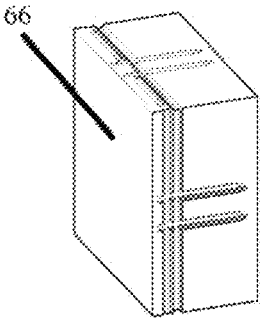
FIG. 20B is another view of FIG. 20A.
Figure 21A:
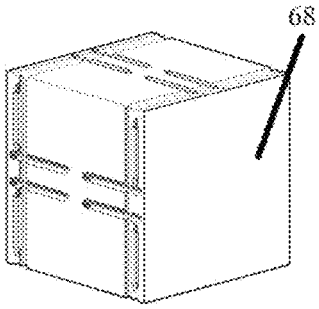
FIG. 21A is a block that can be inserted into the openings of FIG. 19A to make smooth surfaces and FIG. 21A can pull two FIG. 19A pieces together.
Figure 21B:
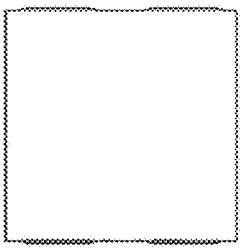
FIG. 21B is a profile view from the front of FIG. 21A.
Figure 21C:
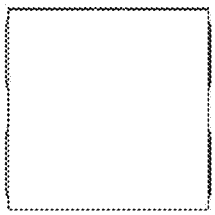
FIG. 21C is a profile view of FIG. 21A from a different angle.
Figure 21D:
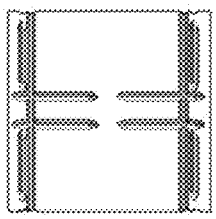
FIG. 21D is another profile view of FIG. 21A from a different angle.

FIG. 20 is a panel (66) that can be inserted into the openings of FIG. 19 (67) both to create a smooth surface and, when inserted at a 90-degree angle to the opening, it secures two FIG. 19 objects together in the same manner that FIG. 16 (57, 59) holds FIG. 1 (58, 60) as is demonstrated in FIGS. 18A and 18B.

FIG. 21 is a block that can be inserted into the openings of FIG. 19 to make smooth surfaces (68) and FIG. 21 can pull two FIG. 19 pieces together. Two cubes in the shape of FIG. 21 can be inserted next to each other in FIG. 19 but cannot be inserted at 90-degree angles to each other. FIG. 21 must be used in conjunction with FIG. 20 to form fully flat surfaces and constructions with FIG. 19.

The Invention is best assembled into a locked position by following this specific assembly sequence. First, insert the magnetic disc that is FIG. 5 into the slot at the top of FIG. 3D (18). Second, insert FIG. 3D into a side of FIG. 1 (4)

until it snaps into the side. Third, from the other side of FIG. 1, insert FIG. 4 through FIG. 1 until it hits the inserted FIG. 3. Fourth, snap FIG. 4 (34) into the FIG. 3 (36) that itself has already been inserted into FIG. 1. This will create the combination of pieces that is depicted in FIGS. 7 and 8 except that the pieces will also be snapped firmly into FIG. 1. Fifth, insert FIG. 2 into a middle opening of FIG. 1 that is perpendicular to the inserted and snapped FIG. 3. The collection of pieces that are FIGS. 7 and 8 will be in the front middle opening of FIG. 12 (43) and FIG. 2 (41) will be inserted vertically as shown in that FIG. 12. Sixth, insert FIG. 10 into FIG. 1 to lock in place FIG. 2 in the manner shown in FIG. 12 (43). Then snap on FIG. 9 objects into the remaining middle openings and snap in FIG. 13 or 15 into the corners (69, 70) and FIG. 16 into the rectangular openings (71, 72) until the entire cube has smooth surfaces. The cube will have smooth surfaces and will be locked such that it cannot be easily disassembled.

To unlock the assembled locked cube, use another cube that is just like it. Position the magnetic discs opposite each other in a manner that makes them repel. This is accomplished by having the parts of the discs with the same charge face each other. The positively charged side of each disc (27) faces each other and the negatively charged side (28) also face each other. This will cause the disc to push inward beneath the outside flat surface. When the disc pushes inward, it will dislodge the object that is FIG. 4 from its snapped position inside FIG. 3. FIG. 4 will become loose and get pushed further into FIG. 1. The center part of FIG. 3 that is just below FIG. 4 when FIG. 4 is snapped into FIG. 3 is flexible and will move up and push FIG. 4 (34) out of FIG. 3 (36). That flexible center can be seen in FIG. 3C (25). The bump on the part of FIG. 3 that faces the magnetic disc is visible towards the top of FIG. 3D (73). That bump holds the magnetic disc in place to keep it from moving around loosely. The bump also pushes FIG. 4 out when the disc is pushed against the bump with magnetic force through the flat outer surface of FIG. 3 (74).

When FIG. 4 (34) is dislodged from FIG. 3 (36) the grip that FIG. 3 (36) has on FIG. 1 through its "s" snaps (33) is less. This is because FIG. 4 (31, 34) is no longer pushing those snaps on FIG. 3 (33) against the snap protrusions and recesses of FIG. 1. With the lessened grip of FIG. 3 it can be more easily dislodged from its snapped-in position on FIG. 1.

Because FIG. 3 has a rigid flat outer surface (74), it cannot be easily dislodged. However, then the magnetic disc of the other FIG. 1 that was used to push the magnetic disc to dislodge FIG. 4 from FIG. 3 is turned around, the discs will attract. When the discs attract, they will have the force necessary to dislodge (with magnetic force) FIG. 3 from FIG. 1. Once FIG. 3 is dislodged from FIG. 1 FIG. 10 can be pushed out (43), which will in turn push out the FIG. 9 that is the flat surface behind FIG. 10 in the FIG. 12 example. Then FIG. 2 (41) can easily be dislodged from FIG. 1.

Two cubes can be locked together when FIG. 2 is lodged in one cube and locked in place with one end of FIG. 2 protruding from the FIG. 1. This is accomplished by locking FIG. 2 in FIG. 1 by pushing FIG. 10 through the top hole of FIG. 2. For example, in FIG. 11, instead of pushing FIG. 10 through FIG. 2 at the lower hole (which is how the pieces are assembled in FIG. 12) FIG. 10 is pushed through the upper large hole in FIG. 2 (75) when they are assembled in FIG. 1. This will allow the bottom of FIG. 2 (in the view of FIG. 11 at element 76) to snap into another FIG. 1 and hold the two FIG. 1 pieces together. The remainder of the cubes can be assembled to be flat in the manner outlined above.

The "s" snaps in FIG. 1 (21, 22) and FIG. 19 (77, 78) can hold onto cylinders and smooth square beams that do not necessarily have corresponding "s" snap features. They can simply give grip to the sides of the FIGs. they are in.

Round beams, pipes and many other things can be inserted into the centers of FIGS. 1 (4) and 19 (67) after they are assembled into larger constructions.

Because the basic dimensions of the Invention follow the same ratios (i.e., basic features are either the same size, half the size, etc., of other features) the Invention can be made exponentially larger or smaller and it can be combined with itself in multiple ways. For example, because the openings in the middle of FIG. 1 (4) and 19 (67) are both half the size of the cubes they are in, another Invention that is half the size of the FIGS. 1 and 19 can fit into either of those pieces, or into both of them. Snaps, beams, and backbone pieces are either interchangeable or can be easily adapted to work with each other when the Invention is made with different materials like glass, recycled materials, metal plastic and the like.

The invention claimed is:

1. A block system comprising a plurality of cubes;

wherein each of said cubes is comprised of a skeletal cube having six smooth sides and eight corner portions and having a square-shaped shaft extending through each of said cube's six sides, each of said square shafts being defined by four sides and having an undulating snap on each of said four sides of said shaft;

wherein each of said skeletal cubes has a receded cube-shaped space defined by three surfaces at each of said cube's corner portions each of said three surfaces of each said cube-shaped space having an undulating snap;

wherein each of said cubes further includes a snap panel comprised of a flat substantially square member with a circular undulating snap extending from one of said snap panel's surfaces, said undulating snap of said snap panel being configured to fit into a respective one of said square shaft openings of said skeletal cube to form a flat surface on said respective side of said surface of said cube;

wherein each of said snap panels has a space configured to hold a magnetic disc;

wherein each of said cubes further comprises of a plurality of corner snap cubes, each of said corner snap cubes comprises three smooth sides and three sides having an undulating snap, each of said undulating snaps of said corner snap cubes are configured to align with respective ones of said undulating snaps of said surfaces of respective ones of said receded cube-shaped spaces;

wherein each of said cubes, when having a respective one of said panels snapped into each respective said shaft and a respective said corner snap cube is received in respective said receded cube-shaped spaces, a substantially smooth cube is formed.

* * * * *